United States Patent [19]

Schultz et al.

[11] Patent Number: 4,748,994

[45] Date of Patent: Jun. 7, 1988

[54] REVERSIBLE WALKER DEVICE

[75] Inventors: Jim R. Schultz, Thousand Oaks; Michael Doom, Canoga Park, both of Calif.

[73] Assignee: Guardian Products, Inc., Arleta, Calif.

[21] Appl. No.: 819,703

[22] Filed: Jan. 17, 1986

[51] Int. Cl.[4] ..... A61H 3/00

[52] U.S. Cl. ..... 135/67; 272/70; 297/5

[58] Field of Search ..... 135/67, 68, 66, 84DIG. 9; 403/385; 5/81 R, 81 B; 272/70.3, 70.4, 70, 62, 63, 97; 128/25 R; D3/6, 7, 8; D12/129, 130, 133

[56] References Cited

U.S. PATENT DOCUMENTS

| | | | |
|---|---|---|---|
| 1,307,058 | 6/1919 | McGrath | 135/67 X |
| 2,362,466 | 11/1944 | Carter | 135/67 X |
| 2,759,525 | 8/1956 | Ries | 135/67 |
| 2,777,657 | 1/1957 | Zent | 403/385 X |
| 2,796,916 | 6/1957 | Womble | 135/67 |
| 2,798,533 | 7/1957 | Frank | 135/67 X |
| 4,045,044 | 8/1977 | Bierer | D12/133 X |
| 4,248,256 | 2/1981 | Thomas | 135/67 |
| 4,251,105 | 2/1981 | Barker | 135/67 X |
| 4,314,576 | 2/1982 | McGee | 135/67 |

FOREIGN PATENT DOCUMENTS

| | | | |
|---|---|---|---|
| 17991 | of 1900 | United Kingdom | 272/70.4 |
| 579543 | 8/1946 | United Kingdom | 272/70 |
| 834105 | 5/1960 | United Kingdom | 272/97 |
| 978587 | 12/1964 | United Kingdom | 272/70.3 |
| 2061118 | 5/1981 | United Kingdom | 272/70.3 |

*Primary Examiner*—Robert A. Hafer
*Assistant Examiner*—Charles H. Sam
*Attorney, Agent, or Firm*—William H. Pavitt, Jr.; Natan Epstein

[57] ABSTRACT

A walking aid adapted for use either before or behind the invalid user and comprising a pair of tubular side sections spaced apart and connected by a transverse brace at one pair of opposed ends to form a four legged free standing walker frame. Each side section support and adjustably disposable upwardly extending hand support enable the latter to be best positioned for the user and for the use of the walker in either its fore of after the patient position.

10 Claims, 3 Drawing Sheets

Fig. 1
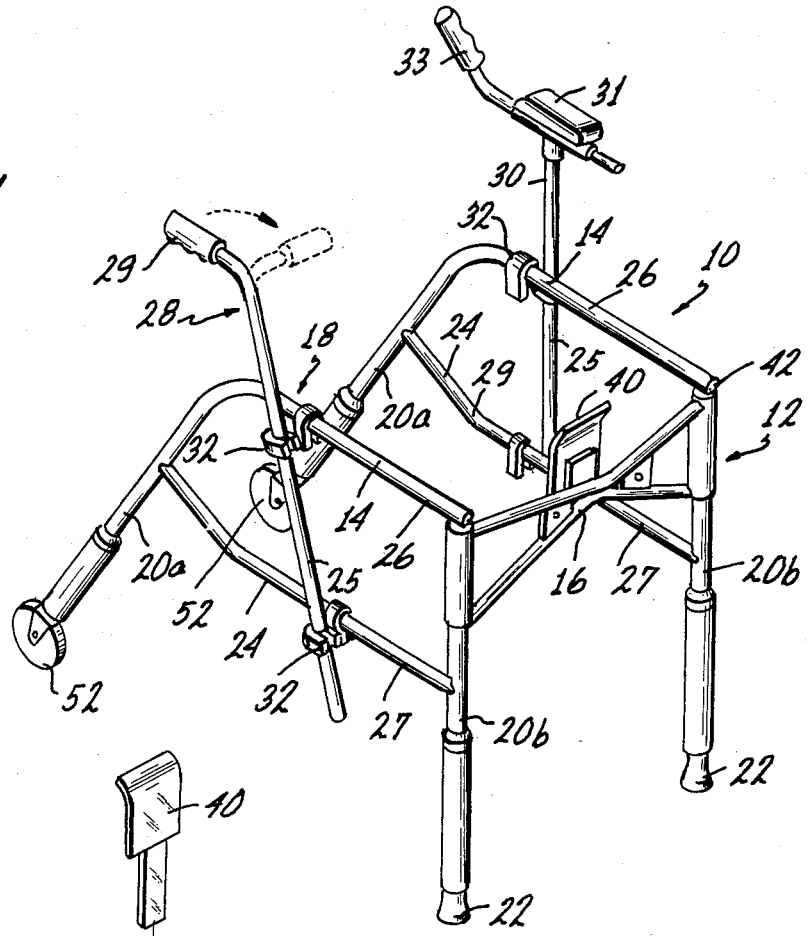
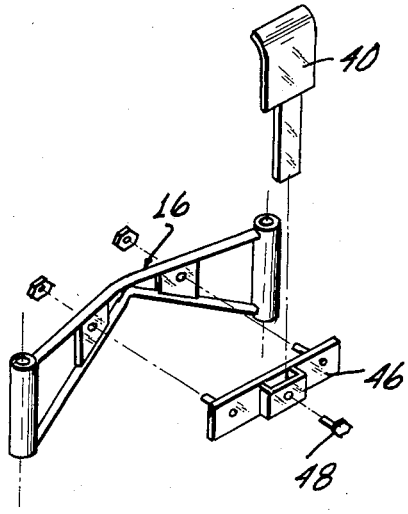
Fig. 4
Fig. 3a
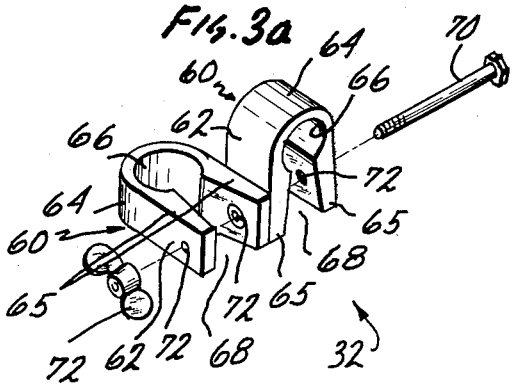
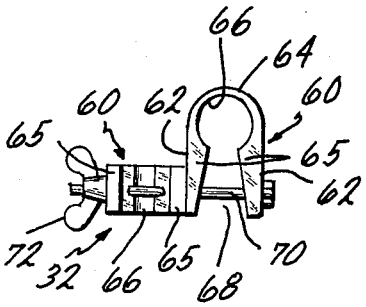
Fig. 3b

REVERSIBLE WALKER DEVICE

BACKGROUND OF THE INVENTION

1. Field of the Invention

The present invention pertains generally to the field of walking aids such as are used by the infirm and the invalid for support during walking, and is more particularly directed to a four legged walker adapted for use in either a normal or a "reverse", behind-the-patient position in which the walker frame is open in front and closed behind the user.

2. State of the Prior Art

Walking aids have long been in widespread use in a great variety of designs and configurations. One category of walking aids comprises four legged walkers such as disclosed in U.S. Pat. Nos. 4,248,256 to Thomas, 4,474,202 to Blechner, and 3,945,389 to Smith, the latter being of common assignee with this application. Four legged walkers usually consist of a lightweight framework typically made of aluminum tubing which can be lifted with minimal effort by even a debilitated individual. The walker frame defines a generally rectangular perimeter about the user which is closed along three sides and open on one side to allow a user to step into the walker frame and take hold of hand grips provided thereon. Thus, the frame of a typical conventional walker as referenced to the user has two side sections usually provided with hand grips, one on each side of the user, and a transverse front section which extends between and interconnects the two side sections. The rear of the walker is open and provides no support.

One shortcoming of prior art walkers is the limited flexibility and adaptability of the walker to the great variety of physical disabilities and impairments encountered in medical practice each susceptible of being best treated by a walker configuration fitted to the particular patient's requirements. Such precise fitting of the walker configuration is not easily achieved with prior art walkers having a limited range of adjustment of the hand grips and patient supports such as platforms, and further improvement in the ease and latitude of adjustment and adaptability of walkers is desirable.

In certain cases a reverse walker position, i.e. one where the open side of the walker is oriented towards the front of the patient and the transverse side is behind the patient can be both physically and psychologically advantageous to the patient. The open front of the walker diminishes the portion of the walker frame visible to the user and removes the closed front as a visual barrier in front of the user, more closely approaching the perception of normal, unassisted walking to further promote and speed rehabilitation.

Conventional walkers are ill suited for use in a reverse disposition and are likely to cause the patient to fall forward if so used. In conventional walkers, such as in the aforementioned patent to Smith, the safety zone defined by the walker footprint is too limited to allow the walker to be used in a reverse position because, among other reasons, the length of the side sections is relatively short. The short side sections do not detract significantly from the usefulness of the device so long as the walker stands in front of the patient and the patient steps towards and into the walker with each stride. In normal use the walker stands in plain view before the user who can easily adjust his position and spacing relative to the walker so as to keep his balance and maintain a sure grip on the walker frame. Further, the user cannot step out of the walker's safety zone because the closed front of the walker frame prevents it. If the same walker is turned around such that the open side is directed towards the front of the user, it will be found that the patient must reach back to keep hold of the hand grips because the side sections are too short to be grasped in a reverse walker orientation while the patient's arms extend in a comfortable position. Even if the patient is able to hold on to the side sections at all, he may be forced to do so at a point dangerously near the ends of the hand rails where stable support is not available, risking tipping of the frame with consequent injury to the patient.

SUMMARY OF THE INVENTION

The walker of the present invention is characterized by a high degree of flexibility and ease of adjustment of the patient support attachments and by its reversibility, that is, it is safety usable in either the conventional leading position where the walker is in front of the patient and the open side of the walker frame faces rearwardly, and a "reversed" behind-the-patient attitude where the open side of the walker frame faces ahead and the walker frame is closed behind the patient. The novel reversible walker is further characterized in that hand grips or platform supports are attachable to the rails of each of the two side sections of the walker frame by means of particularly adapted clamps which can be independently fixed at any continuously selected point between the fore and aft ends of the side rails so as to achieve an unprecedented degree of flexibility in the posititioning and attitude of the hand grips or other patient support attachments, both in the normal and reverse positions of the walker to give the physical therapist ample professional latitude in configuring the walker to the specific disabilities of each particular patient. The position of the attachments must be shifted depending on the orientation of the walker relative to the patient and the exceptionally flexible mounting of such supports according to this invention therefore contributes to the reversibility of the walker.

The walker frame has two side sections connected by a transverse section, the two side sections and transverse section together forming a four legged free standing walker frame. Each side section includes a front and rear leg connected by generally horizontal side rails which are of smooth undeformed substantially constant cross-section.

Each such patient support attachment consists of a tube or cane terminating at its upper end in a hand grip which may be either straight or bent and which may also carry a platform for supporting the patient's arm. One such attachment is secured to each side of the walker frame by clamping to an upper and a lower rail so that the attachment tube is held transversely to the side rails on each side section of the walker. The fore to aft position of the attachment is readily adjustable by momentarily loosening and sliding both of the attachment clamps along the rails to displace the attachment along the rails, while its precise angle of inclination to the walker frame rails is adjustable by sliding only one of the clamps. The continuous positioning of the attachment clamps along each of the rails is unobstructed by hand grips and other devices affixed at intermediate points of the frame tubes or by other deformation of the rail cross section. Finally, the height of each attachment is independently adjustable by sliding the attachment tube axially through the loosened clamps.

The danger inherent in such wide range of adjustment is that the attachments could be arranged in an unstable configuration where the patient's weight could cause the walker to tip over. This risk is minimized by terminating the uppermost side rails rearwardly of the lower extremities of the front legs thereby to prevent the support attachments from being attached to the upper rail too far forwardly and near the forward edge of the walker's footprint, where a risk of instability would be created. The hand grip or platform attachments thus remain well within the walker's safety zone and will not extend out of the same even when mounted at a relatively acute angle across the side rails. This rearward termination of the uppermost side rails is preferably achieved by splaying or angling the legs which face forward when the walker is in the reverse position, such that the lower ends of the legs touch the ground surface forwardly of the forward ends of the uppermost rails of the side sections as projected vertically onto the ground surface.

The novel walker of this invention is further adapted for "reverse" use by extending the length of the side sections to provide a support frame long enough such that the hand grips or other support attachments can be mounted sufficiently far away from the closed rear of the frame to allow the patient adequate and comfortable standing and maneuvering room within the frame while maintaining an easy hold on the hand grips. When used in the behind-patient position, the closed rear of the present walker allows provision of a bumper pad disposed for contacting the user's gluteal region as the walker is advanced with each step taken, lightly but repeatedly "bumping" the user's backside as a continuing and insistent reminder to maintain an erect posture.

As a result of the extended length of the side sections in combination with the splaying of the front legs, the user's weight is maintained within the walker's safety zone at all times in the reverse position.

A further feature of the novel walker when used in a reverse, behind the patient position is that a physical therapist is able, through suitable adjustment of the support attachments, to restrict the patient's body between the support attachments mounted to the side and forwardly of the patient and a gluteal bumper pad disposed behind the patient. The spacing of the attachments to the gluteal pad may be adjusted so as to just accommodate the user in a substantially erect attitude in the walker. If the patient stoops forward while supported by the attachment, his body will curve rearwardly away from the attachment and his backside will make contact the gluteal pad whereby he will be reminded to resume correct posture.

A still further aspect of the present invention is directed to the novel attachment clamps used in adjustably mounting the various support attachments to the walker's side rails. While such support attachments have been used in the past as illustrated by the platform crutch attachment in U.S. Pat. No. 4,248,256 to Thomas, the use of the novel clamps disclosed herein allow easy and highly flexible positioning of the attachments with only a single manually releasable fastener being used in each clamp, release of which simultaneously releases the clamp from both the walker frame and the support attachment.

The attachment clamps each comprise two generally U-shaped clamp elements each adapted to fit about a tubular element such as a hand rail of the walker and a cane attachment to be mounted to the walker. Each clamp element has a U-shaped outer surface including two mutually parallel, substantially plane outer faces connected by an intermediate surface portion contained between the planes of the parallel outer faces. The two clamp elements are held together by a single fastener, such as a bolt and nut, which applies compressive force simultaneously to both clamp elements along a direction substantially perpendicular to all four plane outer faces, clamping each of the two elements about a corresponding tubular element. The two clamp elements, however, are free to rotate about the single fastener. This allows the inclination of a walker attachment secured by two such clamps to be easily adjusted by loosening only one clamp and sliding the loose clamp along the walker rail to a new position. The loose clamp slides along both the rail and the attachment while the other clamp accomodates to the new attachment inclination only by relative rotation of its two clamp elements. The particular configuration of the two clamp elements disclosed herein allows the two clamp elements to be rotated a full 360 degrees relative to each other about the single fastener.

It must be understood that the novel clamps are not limited to use in a walker. The nearest art pertinent to these clamps of which applicant is aware is disclosed in U.S. Pat. No. 2,994,366 to Hoch and forming part of a tray attachment for folding chairs. The Hoch clamps fall short of the present invention in that they are not rotatable through a full circle about the single bolt joining the two clamp elements because their outer surfaces include nearly cylindrical portions which are not contained between the plane outer surfaces and thus interfere with such rotation.

BRIEF DESCRIPTION OF THE DRAWINGS

FIG. 1 is a perspective view showing the reversible walker of this invention configured for reverse, behind-patient use.

FIG. 3*a* shows the novel clamps used to secure the patient support attachments to the walker frame.

FIG. 3*b* is a side view of the clamps of FIG. 3*a*.

FIG. 4 shows the transverse section of the walker frame and an adjustable gluteal bumper pad arrangement for the same.

DETAILED DESCRIPTION OF THE PREFERRED EMBODIMENTS

Figure 5:
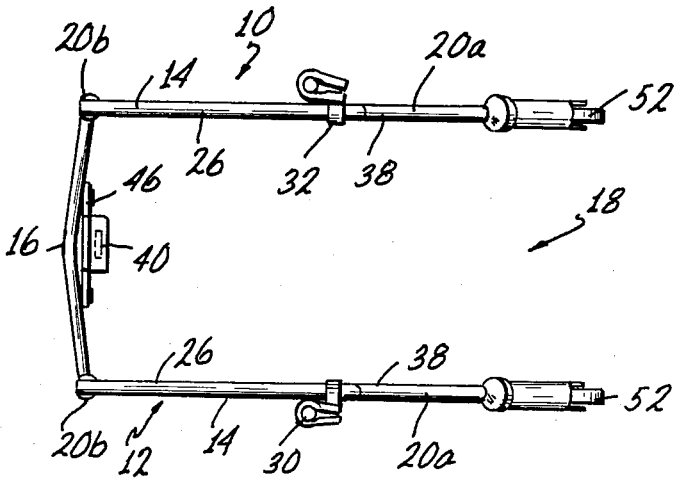
FIG. 5 is a top plan view of the walker configured for reverse use and seen with the upper ends of the support attachments sectioned away.

With reference to the drawings, FIG. 1 shows the novel reversible walker 10 which comprises a tubular walker frame 12 consisting of two side sections 14 interconnected by a transverse section 16 to form a three sided, free standing frame supported by four legs and having an open side 18 as best appreciated in FIG. 5. Viewed in the reverse position each side section 14 includes a front leg 20*a* and a rear leg 20*b*, the rear legs terminating in lower extremities 22, and two side rails 24 and 26 connecting the front and rear legs of each side section. The side rails 24, 26 each have a relatively long generally horizontal mutually parallel straight segment, one such straight segment overlying the other. The two segments are of smooth, constant cylindrical cross-section at least through the straight, generally horizontal portion of each rail. The transverse section 16 is a generally X or butterfly shaped tubular assembly interconnecting the upper portions of the two rear legs **20*b***.

Figure 6:
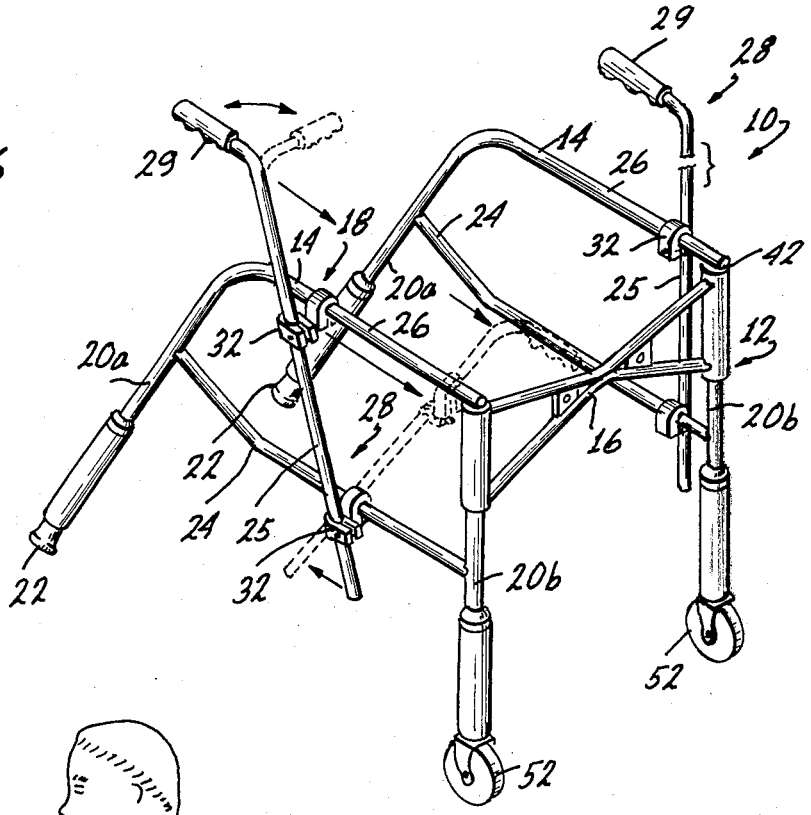
FIG. 6 is a perspective view of the reversible walker configured for use in a conventional position relative to the user.

The basic walker frame 12 may be adapted to the particular physical requirements of different users by mounting selected support attachments to the frame 12. While most frequently the walker will be equipped with two similar canes 28 such as shown in FIG. 6 with curved upper ends to form horizontal hand grips 29, other possible attachments include a cane 34 with a vertical hand grip in FIGS. 1 and 2, and a platform attachment 30 having a forearm rest 31 and a handgrip 33 shown in FIG. 1. Each of the attachments is fastened to the frame by means of two clamps 32 secured to the upper and lower rails 26, 24 respectively of a corresponding side section 14. The attachment clamps 32, which will be described in greater detail below, each consist of two pieces or elements pivotably connected together by a single fastener bolt and nut which also operates to simultaneously tighten the two clamp elements around the attachment tube and the walker frame rail. The two clamp elements are free to pivot in relation to one another as required by the desired adjustment of the attachment position, thus allowing great ease and flexibility in positioning and arrangement of the different attachments relative to the walker frame 12 so as to complement the particular physical handicap of any given user, and further permit quick and easy readjustment of the attachment as the patient's requirements change with time.

Each of the various support attachments 28, 30, 34 have a relatively long straight tubular lower shaft portion 25 to which are attached two mounting clamps 32 in spaced apart relationship. Each clamp is also attached to one of the rails 24, 26 on one side 14 to secure the attachment to the walker frame 12. The angular disposition or inclination of the attachment tube relative to the walker frame 12 is readily adjustable by sliding one of the clamps 32 relative to the other clamp along the rails 24, 26. In this manner for example, the cane 28 in FIG. 1 can be readily brought from the solid lined to the phantom lined position by merely sliding the upper clamp 32 along rail 26. The cane 28 may also be rotated to adjust the hand grip position as shown. The adjustment range of the support attachments is maximized by allowing for uninterrupted sliding of the attachment clamps along the full length of the upper rail 26 from the transverse section 16 to its forward end at bend 38. The lower rail 24 allows for uninterrupted sliding of the lower clamp along a straight segment 27 of similar length before the lower rail 24 curves upwardly at 29 to meet the splayed leg **20*a*. The ability to freely slide the attachment clamps along major segments of the rails, in combination with the two piece clamps described below makes for the great flexibility and latitude of adjustment and in particular for the reversibility of the present walker. The height of the attachment relative to the frame is easily adjustable by axial sliding of the attachment tube through the two spaced apart clamps 32. The attitude of the attachment is also readily adjustable by rotation of the attachment tube within the two clamps about the axis of the shaft 25 as illustrated by rotation of the cane 28 with the horizontal hand grip 29 from the solid line to the phantom line position in FIG. 1**.

Figure 2:
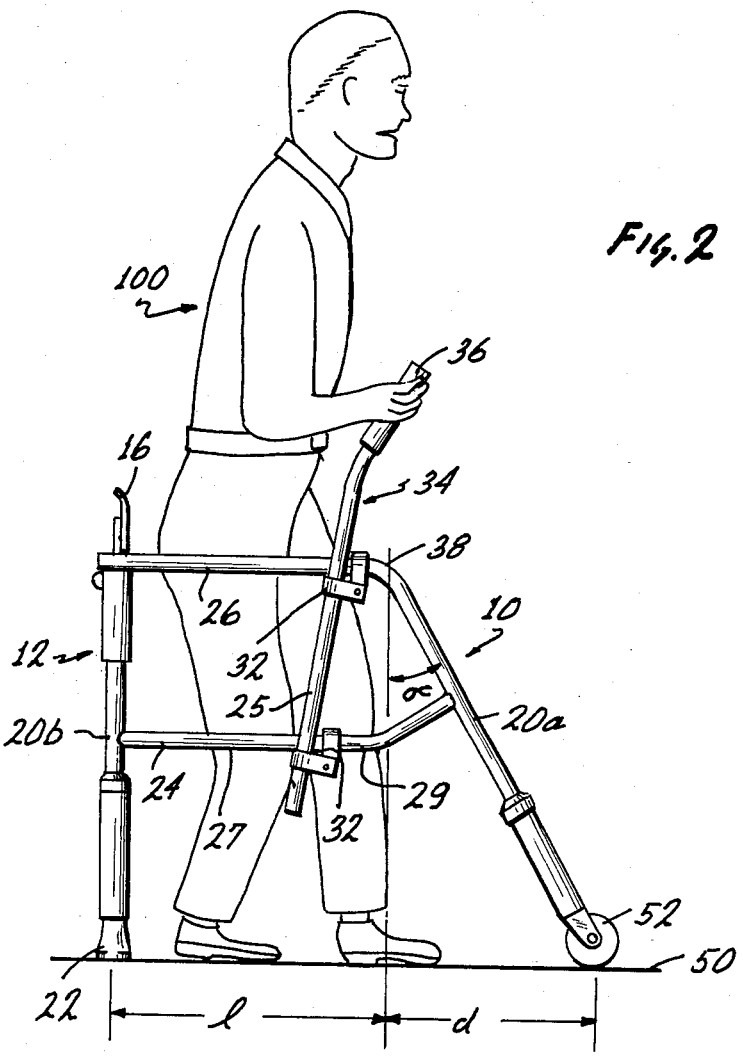
FIG. 2 is a side elevational view of the walker of FIG. 1 shown in typical reverse use by a patient.

With reference to FIG. 2, it can be seen that the use of attachments such as the cane 34 terminating in an elevated upper hand grip 36 increases the leverage that can be exercised by the user 100 over the walker frame 12. For example by applying a relatively modest forward force onto the cane handle 36 a substantial amount of forward pivotal leverage can be applied to the walker frame 12. Since the walker is to be used by enfeebled or otherwise handicapped persons such forward force can be accidentally applied and must be guarded against to prevent accidental tipping over of the frame. As has been discussed above use of the walker in a reverse position entails somewhat greater risk of instability and to minimize this, the legs **20*a* slant or splay forwardly at an angle alpha such that their lower extremities (in this case provided with wheels 52) touch the ground 50 a distance "d" forwardly of the ends 38 of the side hand rails 26 as projected onto the ground surface. The effective length "l" of the side rails 26, measured from the transverse section 16 to the bend point 38 of the side rails 26, is sufficient to allow a user 100 to take a stride forward without stepping out of comfortable reach of the attachments, and above all without stepping out of the walker's safety zone. The stride is measured from a beginning position with the transverse section 16 of the frame 12 substantially against the back-side of the user 100, bearing in mind that the typical user of the walker will not be able to take long strides. Having taken the stride, the user 100 will find himself near the ends 38 of the side rails 26 and at some distance forwardly of the transverse section 16. In an interrupted gait mode the user may then stand still while the walker 10 is moved forwardly until the transverse section 16 again abuts against the back-side of the user 100. The transverse section 16 will gently "bump" against the backside of the user following each step as a reminder to the patient to maintain an erect attitude while walking. This bumping action is enhanced by provision of a gluteal pad or bumper plate 40. As seen in FIG. 4 the gluteal pad 40 may be mounted on a support 44 slideable through a bracket 46 mounted to the transverse section 16. The height of the gluteal pad 40 relative to the frame section 16 can be fixed by means of set screw 48 threaded through the bracket 46 to lock the support 44 against sliding movement therethrough. The adjustable height feature of the gluteal pad 40 further increases the versatility of the walker 10** by allowing adjustment to different patient heights and anatomies.

In cases where a patient is able to and prefers to use the walker in a smooth gait mode the aforementioned repeated gluteal bumping may occurr with less regularity. However, the completely flexible positioning of the attachments enables the therapist to configure the walker so that the patient's buttocks are closely spaced from the gluteal pad while the patient is in normally erect posture and holding onto the cane grips or platform supports. If thereafter the patient stoops forward his spacing from the hand grips or platform will tend to remain approximately the same as dictated by natural and comfortable arm extension and position, whereas his buttocks will tend to move rearwardly into contact with the gluteal pad or closed rear of the walker frame due to the curvature of the body associated with stooping or bent posture. This contact is intended as a reminder to resume correct posture.

In the preferred embodiment shown in the drawings, the forward legs 20*a* and the upper side rails 26 are formed of a single continuous length of tubing bent at 38 to define the forward termination point of the upper side rails 26 and the commencement of the leg 20*a*. The bend 38 also marks the forward limit for attachment of the upper clamp 32 used to secure a support attachment such as cane 34. So long as this forward limit is not surpassed, the leverage provided by the upwardly extending attachments will not create a substantial danger of forward tipping of the walker device due to the forward extension of the legs 20*a*. In other words, the footprint of the walker which has a length of 1+d measured between the lower extremities of the front and rear legs extends substantially forwardly of the front termination points 38 of the upper rails 26 as projected vertically downwardly onto the ground surface.

The front legs 20*a* of the walker may be provided with casters or wheels 52 for assisting the patient in advancing the walker following each step, while the rear legs 20*b* terminate in rubber feet which drag over the ground surface in order to prevent the walker from rolling out of control. The use of wheels is particularly desirable to allow the walker to move forward together with the user 100 for a smoother, more continuous joint forward motion but are in any event optional.

Figure 7:
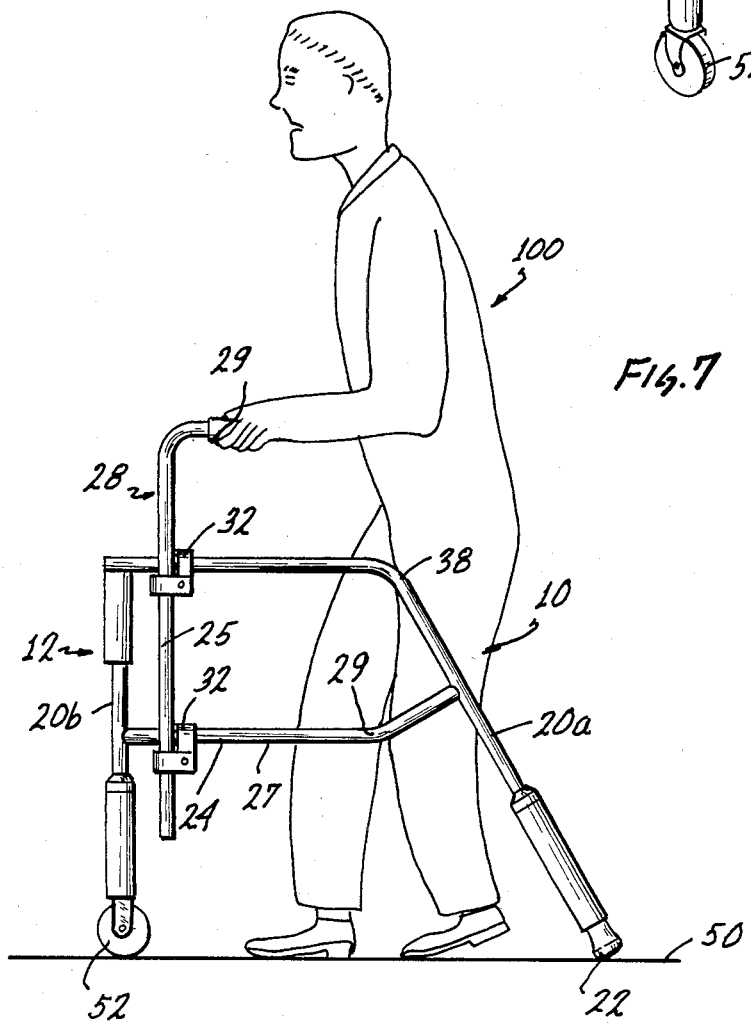
FIG. 7 is a side elevational view of the walker illustrated its arrangement for use in front the patient.

The reversible walker 10 is shown in FIGS. 6 and 7 configured for use in a normal position with the transverse portion 16 in front of the patient and without the gluteal pad. The splayed legs 20*a* earlier referred to as the forward legs now become the rear legs while the legs 20*b* are now the front legs. The wheels 52 have been moved from legs 20*a* to legs 20*b* and the tip stands 22 placed on legs 20*a*. The reversal is completed by moving the canes 28 or other attachments along the side rails 24, 26 to a suitable position nearer to the transverse side 16, as in FIG. 7.

It is contemplated that the novel walker may be constructed in different sizes to suit persons of all ages and varying statures as for example, three sizes for use by children, youths and adults respectively. Both the dimensions of the walker frame as well as the splay angle of the front legs may vary. Presently preferred approximate walker dimensions according to this invention are as follows:

| | child | youth | adult |
|---|---|---|---|
| top rail length | 8¼ | 12⅜ | 13 3/16 |
| front leg splay angle | 45 | 30 | 22 |
| walker frame width | 16⅜ | 19 | 19¼ |
| minimum walker height | 11.5 | 22 | 27 |
| max. extended walker height | 21 | 37 | 40 |

Turning now to FIGS. 3*a* and 3*b*, the novel clamps 32 earlier referred to are seen to each include two substantially identical U-shaped clamp elements 60, each clamp element having a U-shaped outer surface consisting of two plane side faces 62 which are mutually parallel and are joined by an intermediate semi-cylindrical outer surface portion 64. The interior of each clamp element 60 includes a divergent slot 68 opening into a cylindrical bore 66. The two clamp elements 60 are held in mutually abutting relationship at one of the planar side surfaces 62, as shown in the referenced drawings, by means of a single bolt 70 perpendicular to all four side faces 62 extending through aligned bores 72 in the two clamp elements 60. Clamping force is applied simultaneously to both clamp elements 60 by means of a wing nut 72 threaded onto the bolt 70 as shown in FIG. 3*b*. The nut 72 applies clamping force to urge together the two arms 65 in each of the clamp elements 60 and thus simultaneously close both clamp elements 60 so as to clamp tubular elements extending through each of the two cylindrical bores 66, as seen in the walker of FIGS. 1, 2 and 5 while also retaining the two elements 66 in face-to-face abutting relationship. The clamp elements 60 are rotatable relative to each other so as to accomodate any angle between an attachment shaft 25 and a side rail 24, 26.

The U-shaped outer surface of the two clamp elements 60 wherein the semi-cylindrical intermediate surface 64 is contained between the mutually parallel planar surfaces 62 allows the two clamp elements 60 to be rotated a full 360 degrees relative to each other about the axis of the bolt 70 so as to accomodate any angle between the attachment and the side rails and thus permit ready and easy mounting and readjustment of attachments such as 28, 30 in FIG. 1 by simply loosening the wing nut 72 thereby to simultaneously release both clamp elements 60 from the tubular rails and the attachment, one of the rails 24, 26 passing through one clamp element 60 while the attachment shaft 25 extends through the other clamp element 60 of each mounting clamp 32.

While particular embodiments of the invention have been shown and illustrated for purposes of clarity, still other changes, substitutions and modifications will be apparent to those possessed of ordinary skill in the art. The foregoing description and illustrations are therefore only by way of example and not limitation, and the scope of the invention is defined only by the following claims.

What is claimed is:

1. A walker comprising:

a free standing walker frame having two sides, each side including two legs connected by at least an upper and a lower generally horizontal rails, and a transverse section interconnecting said two sides;

one or more patient support attachments, each attachment having a lower shaft and patient support means at its upper end;

each of said support attachments being secured to one said side of the walker frame by clamp means including an upper clamp and a lower clamp securing said lower shaft to said upper rail and said lower rail respectively, each one of said clamps being independently releasable for simultaneous sliding movement along one of said rails and along said attachment shaft for changing the relative angular relationship between said attachment shaft and said rails, the other of said clamps accommodating to said changed angular relationship without displacement along either its corresponding rail or said attachment shaft.

2. The walker of claim 1 wherein each of said clamp means comprise first and second clamp elements respectively attacheable to said lower shaft and one of said rails, said two clamp elements being pivotably connected to each other so as to accomodate varying angular relationships between said lower shaft and said rails.

3. The walker of claim 2 wherein said two clamp elements are held pivotably together by a single fastener, said single fastener also being operative for simultaneously tightening said two clamp elements about said lower shaft and said rail respectively.

4. The walker of claim 1 wherein each said clamp has two U-shaped clamp elements each apertured for receiving a tubular element between two arms and having a U-shaped outer surface including two mutually parallel substantially plane outer faces connected by an intermediate section contained between the planes of said parallel outer faces, said two clamp elements being juxtaposed at one of said outer faces of each element, and fastener means for releasably applying compressive force simultaneously to both elements along a direction substantially perpendicular to said plane outer faces thereby to maintain said elements in juxtaposed relationship while clamping each element about a corresponding tubular element said clamp elements being rotatable through a full circle relative to each other about said fastener to thereby allow unimpeded relative positioning of said tubular elements prior application of said compressive force.

5. The walker of claim 4 wherein said fastener means comprise a single bolt extending through both said clamp elements in said substantially perpendicular direction and a nut threadable onto said bolt.

6. The walker of claim 1 wherein said upper and lower rails each have a substantially straight mutually parallel section of substantially constant cross section to allow unimpeded sliding of said clamps therealong.

7. The walker of claim 1 wherein said two side sections each include a forward leg and a rear leg each said leg terminating in a lower extremity;

said transverse section interconnecting said rear legs of said side sections;

the lower extremities of said front legs being spaced from the lower extremities of said rear legs by a distance substantially greater than the length of said upper rails, said distance also being equal or greater than the length of an average human stride.

8. The walker of claim 7 wherein said front legs have upper ends connected to said top rails and said from legs are splayed forwardly from their upper ends to their lower extremities.

9. The walker of claim 7 further comprising gluteal bumper means attached to said transverse section adapted and positioned for bumping against the backside of a user.

10. The walker of claim 9 wherein said bumper means are adjustable in position relative to said transverse section.

* * * * *